US005433798A

United States Patent [19]

Takano et al.

[11] Patent Number: 5,433,798

[45] Date of Patent: Jul. 18, 1995

[54] HIGH STRENGTH MARTENSITIC STAINLESS STEEL HAVING SUPERIOR RUSTING RESISTANCE

[75] Inventors: Koji Takano; Mizuo Sakakibara; Satoshi Araki; Takayoshi Matsui; Wataru Murata; Koichi Yoshimura, all of Hikari, Japan

[73] Assignee: Nippon Steel Corporation, Tokyo, Japan

[21] Appl. No.: 179,804

[22] Filed: Jan. 11, 1994

[30] Foreign Application Priority Data

Jan. 12, 1993 [JP] Japan ..... 5-003442

[51] Int. Cl.[6] ..... C22C 38/44; C21D 8/06

[52] U.S. Cl. ..... 148/325; 148/326; 148/597

[58] Field of Search ..... 148/325, 326, 597; 420/67, 68, 69

[56] References Cited

U.S. PATENT DOCUMENTS

| | | | |
|---|---|---|---|
| 5,008,072 | 4/1991 | Siga et al. | 148/325 |
| 5,167,731 | 12/1992 | Minami et al. | 148/325 |

FOREIGN PATENT DOCUMENTS

| | | | |
|---|---|---|---|
| 0178334 | 4/1986 | European Pat. Off. . | |
| 0472305 | 2/1992 | European Pat. Off. . | |
| 648354 | 3/1985 | Germany . | |
| 0136997 | 4/1985 | Germany . | |
| 853124 | 11/1960 | United Kingdom . | |
| 711158 | 1/1980 | U.S.S.R. | 148/325 |

*Primary Examiner*—Deborah Yee
*Attorney, Agent, or Firm*—Kenyon & Kenyon

[57] ABSTRACT

High strength martensitic stainless steel having high rusting resistance which comprises, by weight, 0.13 to 0.20% of C, 0.5 or less of Si, 2.0% or less of Mn, 1.0 to 2.5% of Ni, 12.0 to 16.0% of Cr, 1.3 to 3.5% of Mo, 0.06 to 0.13% of N, if necessary, 0.001 to 0.010% of B, or 0.05 to 1.0% of Ti, 0.05 to 1.0% of Nb, which satisfies 16 to 21% of ARI value for rusting resistance index (Formula (1)), less than 0% of DI value for a δ-ferrite content index (Formula (2)), less than 0% of MI value for martensite content index (Formula (3)), less than 260% of $W_1$ or $W_2$ value for a cold workability index (Formulas (4) or (5)), with the balance comprising substantially Fe and inevitable impurities, said steel being characterized in that the martensite structure or the tempered martensite structure is contained, in which a Cr carbide of 0.2 μm or less in grain size is deposited, especially enabling to produce a self drilling-tapping screw superior in screwing ability and rusting resistance, a nail superior in driving ability and rusting resistance, a cutter having high rusting resistance, a high strength spring superior in rusting resistance, etc.

$$ARI = Cr + 2.4Mo \quad \text{Formula (1)}$$

$$DI = Cr + 1.21Mo + 0.48Si + 2.48Al - (24.5C + 18.4N + Ni + 0.11Mn) - 10.0 \quad \text{Formula (2)}$$

$$MI = Ni + 30C + 0.12Mn + 18N + 0.83(Cr + 1.5Si + 1.4Mo) - 25.0 \quad \text{Formula (3)}$$

$$W_1 = 24Mo + 13.3Cr + 6Mn + 6Si + Ni \quad \text{Formula (4)}$$

$$W_2 = 24Mo + 13.3Cr + 6Mn^{*}6Si + Ni + 10Ti + 10N_b \quad \text{Formula (5).}$$

11 Claims, 2 Drawing Sheets

HIGH STRENGTH MARTENSITIC STAINLESS STEEL HAVING SUPERIOR RUSTING RESISTANCE

BACKGROUND OF THE INVENTION

1. Field of the Invention

The invention relates to martensitic stainless steel of high strength which is applied to fields requiring rusting resistance and more particularly for use, for example, as a screw of superior screwing ability; a nail of superior driving ability and also rusting resistance; a cutter of superior rusting resistance and a .spring of superior rusting resistance.

2. Description of the Prior Art

Heretofore, a carbon steel special screw called a self drilling tapping screw 1 as shown in FIG. 1 has been used for a fixing process by screws on carbon steel products and surface treated steel sheets. And, for the purpose of the improvement of work efficiency and cost reduction, a direct fixing method has been put into practical use in which the screwing process is performed directly from the surface of a steel plate 2 without forming holes beforehand as shown in FIG. 2.

That is, this method applies a screw formed in the shape of a drill (a cutting edge) at the pointed end of it so as to fix the steel plate 2 to a lower steel construction 3 by simultaneously drilling and tapping them with the screw part.

Recently, however, as environmental conditions have become worse due to acid rain, etc., it is more strongly required to change from a carbon steel self drilling-tapping screw to one with high rusting resistance, i.e., a stainless one.

And recently, from the susceptibility and rusting resistance point of view, the area of application of stainless steel products is expanding widely into architecture or architectural material, vehicles, etc. In these cases, stainless steel products of this kind have been used in surface construction by means of spot welding or a fixing process by screws. However, changing of a stainless steel screw which is used in such a screwing process to a self drilling tapping screw could not be performed because of insufficient hardness. For this reason, heretofore, a fixing technique as shown in FIG. 3 has been applied unavoidably, where a steel construction 3 in which an under-hole 7 is previously provided for insertion of a screw and a stainless steel product 5 in which a middle-hole 6 is previously provided for passing of a screw are positioned so that both holes may be aligned and then fixed with a stainless screw 4 through the holes. However, for the purpose of the improvement of work efficiency and cost reduction, it has been more often required to change such a stainless screw to a self drilling-tapping screw. In this case, to screw into a steel plate of 5 mm or more in thickness, a cutting edge of the screw should be 500 or more in Vickers hardness and 400 or more for threads and roots of the screw.

Rusting resistance equivalent to SUS304 is also particularly required for a head of the screw because it is exposed on the surface of a steel sheet.

And, high toughness of 60 J/cm$^2$ or more in impact value is required for both the head part and a shaft part of the screw in order to prevent them from being damaged when screwing.

Furthermore, a raw material for the screw is required so that work for forming the cutting edge, work for screw thread cutting and work for forming the screw head can be easily carried out.

As described above, a raw material must have characteristic such as high cold workability in working time, and such as high strength of 500 or more in Vickers hardness, rusting resistance equivalent to SUS304 and high toughness in a use.

Heretofore, attempts to use austenitic stainless steel having high workability and hardening property as such a material have been tried, however it is inferior in cold workability and the lifetime of tools.

Products made of austenitic stainless steel such as SUS305, SUSXM7, etc., which have been hardened by nitriding after cold working, are also on the market. However, such a surface treated material by nitriding is inferior in rusting resistance to SUS304.

Products made of martensitic stainless steel, SUS410, which has been treated with nitriding quench process after cold working, have also been suggested. However, they are inferior in rusting resistance to SUS304.

Furthermore, heretofore, martensitic stainless steel having a high quenching ability and containing no δ-ferrite, and which contains 0.15% of C; 0.2% of Si; 0.68% of Mn; 6.2% of Ni; 11.3% of Cr; 2.1% of Mo; 0.15% of N; 0.15% of Zr, has been suggested as a material having high strength, high toughness and high rusting resistance. However, the target characteristics have not been obtained because not only is it impossible to carry out cold working having a high reduction such as a heading process, etc., owing to lowering of $Ac_1$temperature (i.e., 560° C.) causing increased softening resistance when annealing, but also screwing ability is inferior owing to lowering of quenched hardness of 500 or less (480) in Hv.

As described above, a material having all the characteristics mentioned above at the same time has not been found. Therefore, such a self drilling-tapping screw that is obtained by joining a tool carbon steel shaped like a drill to the tip of a screw prepared by hardening stainless steel such as SUS305 or SUSXM7 with cold working, is inevitably used.

Such a self drilling-tapping screw that is obtained by putting a plastic cap on the screw head of a carbon steel self drilling-tapping screw to give rusting resistance only to the screw head, is also used.

However, it could not be said that these techniques have achieved the desired goal in spite of the fact that development of such a screw as a single body is still proceeding, because they still cost too much.

SUMMARY OF THE INVENTION

An object of the invention is to provide a martensitic stainless steel by which all the problems mentioned above are solved.

Another object of the invention is to provide a wire rod having a very high cold workability at a low cost, which can be used as material for producing a screw, a nail, a spring, etc., having high hardness and high rusting resistance.

A further object is to provide a self drilling-tapping screw having both superior rusting resistance and screwing ability at a low cost.

For attaining said purposes, the inventors have developed the techniques described below.

That is, upon investigation of various constituents of martensitic stainless steel, the inventors found that martensitic stainless steel has a rusting resistance equivalent to SUS304, or a pitting corrosion generating potential of 200 mv or higher, in the case where the steel contains, by weight, 0.1 to 0.5% of Si; 0.1 to 2% of Fin; 12.0 to 16.0% of Cr; 1.3 to 3.5% of Mo, and has a martensite structure or tempered martensite structure, while the existence of 0.2 μm or more of a Cr carbide is not recognized, at 16 to 21% of ARI value and less than 0% of DI value, which is expressed in the following Formulas (1) and (2):

$$ARI = Cr + 2.4Mo \quad (1)$$

$$DI = Cr + 1.21Mo + 0.48Si + 2.48Al (24.5C + 18.4N + Ni + 0.11Mn) - 10.0 \quad (2)$$

In addition, it was found that, when 1.0 to 2.5% of Ni; 0.13 to 0.2% of C; and 0.06 to 0.13% of N are added to the above steel, and the MI value, that is, an index showing the amount of martensite which is expressed in the Formula (3), is less than 0%, hereby the martensite hardness after quenching or after quenching-tempering becomes Hv≧500.

$$MI = Ni + 30C + 0.12Mn + 18N + 0.83(Cr + 1.5Si + 1.4Mo) - 25.0 \quad (3)$$

Furthermore, it has been found that, if 1.0 to 2.5% of Ni is contained in the above-mentioned stainless steel, while keeping $Ac_1$ at 650° C. or higher, and the $W_1$ value, i.e., an index of cold workability expressed in the Formula (4), is kept at less than 260%, cold workability is improved because of low softening resistance at annealing, so that a screw head, etc., can be subjected to cold working process having a high reduction without being cleaved.

$$W_1 = 24Mo + 13.3Cr + 6Mn + 6Si + Ni \quad (4)$$

That is, the stainless steel satisfying the constituent condition mentioned above and the Formulas (1)–(4) while having the martensite structure (including a tempered structure) exhibits both superior rusting resistance equivalent to SUS304 and a martensite hardness of Hv≧500. Furthermore, the steel satisfying the above-mentioned constituent condition and the Formulas (1)–(4) exhibits the effect by which the cold workability may considerably be improved in the case where the hot rolled material consisting of said steel is subjected to cold working after being annealed; and hot rolled and annealed wire rod is 950 N/mm$^2$ or lower in the wire rod tensile strength and therefore, such a wire rod is extremely excellent in cold workability.

In addition, the desirable annealing after rolling for a wire rod as mentioned above may be performed by a two-stage process to reduce processing time. That is, first the rod is annealed at 700° to 800° C. for at least 0.5 hours, then cooled down to 100° C. and subsequently annealed at 600° to 750° C. for 0.5 hours or longer as the second stage.

The addition of 0.001 to 0.010% of B to said constituent of steel makes the wire rod tensile strength after annealing 930 N/mm$^3$ or lower to further enhance the cold workability, while the martensite hardness after subsequent quenching becomes Hv≧520, permitting the toughness to be improved.

The addition of 0.05 to 1.0% of Ti and 0.05 to 1.0% of Nb further enhances the rusting resistance.

Furthermore, the $W_2$ value, i.e., the index of cold workability expressed in the Formula (5), is kept at less than 260%, so that cold workability is improved because of low softening resistance at annealing, so that a screw head, etc. can be subjected to cold working process having a high reduction without being cleaved.

$$W_2 = 24Mo + 13.3Cr + 6Mn + 6Si + Ni + 10Ti + 10Nb \quad (5)$$

The martensitic stainless steel mentioned above may be well suited to the formation of a self drilling tapping screw which requires screwing ability and rusting resistance.

That is, a screw may easily be shaped from hot rolled wire rod which has been annealed in the manner described above, and furthermore, production of a self drilling tapping screw with a cutting edge hardness of Hv≧500 and capable of drilling into a SS400 steel sheet of 5.5 mm in thickness, is possible by quenching the screw from a temperature range of preferably 1050° to 1300° C. at a cooling rate of 0.5 °C./s or higher, and subsequently by tempering it in a temperature range of 100° to 400° C.

DESCRIPTION OF THE PREFERRED EMBODIMENTS

Figure 1:
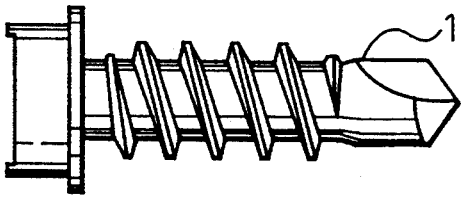
FIG. 1 is an elevational view of a self drilling tapping screw.
Figure 2:
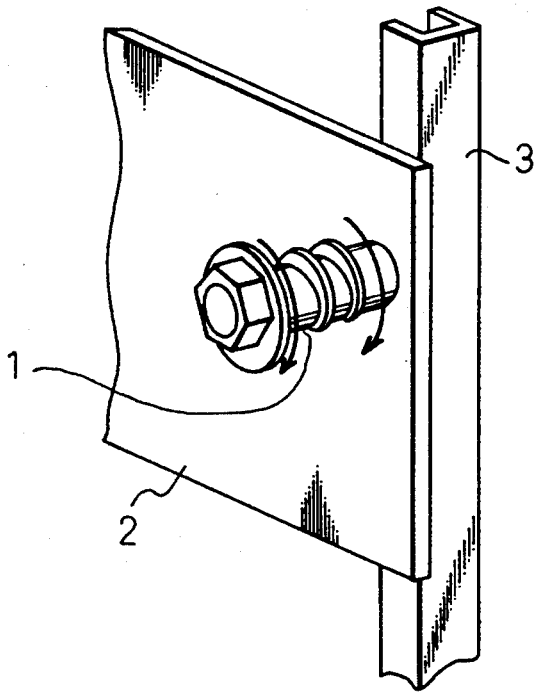
FIG. 2 is a perspective diagram showing usage of a carbon steel self drilling tapping screw.
Figure 3:
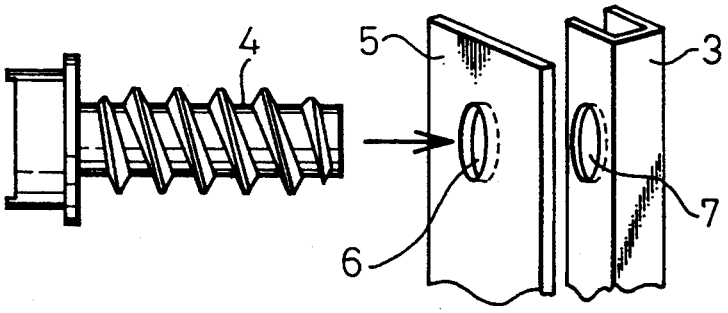
FIG. 3 is a perspective illustration of a screwing condition of a stainless screw.

First, an explanation is given in the following to illustrate the applicable limit of constituents of the martensitic stainless steel used in the present invention:

C is added in an amount of 0.13% or more (hereinafter referred to as weight %), to ensure a Vickers hardness of the martensitic stainless steel of 500 or higher. However, the upper limit is defined by 0.20% because that addition in excess of 0.20% may precipitate a coarse carbide which deteriorates the rusting resistance and the cold workability, and makes the MI value larger so a retained austenite structure may appear, resulting in a lower quenched hardness.

Si is a useful element for deoxidation, however the upper limit is defined by 0.5% because addition in excess of 0.5% may deteriorate the cold workability extremely. The lower limit is defined by 0.1% because poor deoxidation results at less than 0.1%.

Mn is added for deoxidation, for formation of austenite and for solid solving of N, however the upper limit is defined by 2.0% because addition in excess of 2.0% may not only deteriorate the rust resistance, but also make the MI value larger so that a retained austenite structure may appear, lowering the quenched hardness. The lower limit is defined by 0.1% because the effects mentioned above may not be obtained at less than 0.1%.

Cr is added in an amount of 12.0% or more, not only lowers the MI value to decrease the retained austenite structure while enabling a martensite structure to be effectively obtained, but also increases the ARI value in the Formula (1) to provide rusting resistance. However, the upper limit is defined by 16.0% because addition in excess of 16.0% may cause an excessive value of DI in the Formula (2) so that a δ-ferrite structure may appear, thus lowering the quenched hardness and the rusting resistance extremely.

Mo is added in an amount of 1.3% or more, not only increases the ARI value to provide rusting resistance, but also improves the toughness. However, the upper limit is defined by 3.5% because addition in excess of 3.5% may result in saturation of the effects and simultaneously may cause an excessive value of DI so that a δ-ferrite structure may appear, thus lowering the quenched hardness and the rusting resistance extremely.

Ni is added in an amount of 1.0% or more to enhance the toughness of the martensite structure. However, the upper limit is defined by 2.5% because addition in excess of 2.5% may result in saturation of the effect, besides being wasteful. In addition, it causes a drop in the $Ac_1$temperature to reduce the annealing temperature, thus making softening difficult while deteriorating the cold workability. Furthermore, addition in excess of 2.5% may not only raise the susceptibility to stress-corrosion cracking, but also increase the MI value in the Formula (3) so that a retained austenite structure appears, lowering the quenched hardness.

N is added in an amount of 0.06% or more, to raise the quenched hardness; to improve the rusting resistance of base material; and to lower the DI value to control the δ-ferrite structure and simultaneously provide rusting resistance. However, the upper limit is defined by 0.13% because by adding in excess of 0.13%, an added amount of N in the steel goes above a limit of an amount of solid solution of N and as a result, bubbles or Cr carbide-nitrides are formed and the rusting resistance is deteriorated.

B serves to lower the hardness after annealing, thus enhancing the cold workability, in addition improving the quenched hardness and the toughness in a strengthening process for final products. Furthermore, B serves to improve the hot workability, increasing the producibility. Therefore, when above-mentioned effects are particularly required to steel processing in the present invention, B may be added within a range of 0.001 to 0.010%. However, the upper limit is defined by 0.010% because addition in excess of 0.010% may precipitate a boride to lower the toughness and the hot workability and at the same time deteriorate the rusting resistance. The lower limit is defined by 0.001% because the above effects could not obtained at less than 0.001%.

Ti is an effective element by which a Cr carbide nitride may be controlled during cooling to enhance the rusting resistance and is added according to demand. However, the upper limit is defined by 1.0% because addition in excess of 1.0% may result in saturation of the effects mentioned above, besides being wasteful. The lower limit is defined by 0.05% corresponding to the lowest value where the effect can still be exhibited.

Nb is an effective element by which a Cr carbide nitride may be controlled during cooling to enhance the rusting resistance and is added according to demand. Addition in excess of 1.0% may result in saturation of the effects mentioned above, while with less than 0.05%, the effect will cease to exist, thus the limit being defined in a range of 0.05 to 1.0%.

Referring now to the equations specified in the present invention, the formula for ARI was obtained as a result of investigating effects of various elements on rusting resistance of a base material, indicating elements being successful for rusting resistance and the degree of effects. For rusting resistance, Cr and Mo may be the most effective. The ARI value is set at 16% or more for enhancement of rusting resistance of a base material, however a value in excess of 21% may deteriorate the producibility, thus defining the upper limit by 21%.

The formula for DI was obtained as a result of investigating effects of various elements on an amount of δ-ferrite in a base material, indicating elements being effect for an amount of δ-ferrite and the degree of effects. Cr, Mo, Si, C, N, Ni and Mn are effective elements to decide said amount. A DI value in excess of 0% may cause an appearance of δ-ferrite and as a result, quenched hardness and toughness are decreased and moreover a carbite nitride precipitates in the interface of δ-ferrite at quenching to extremely deteriorate rusting resistance, thus defining the upper limit as less than 0%.

The formula for MI was obtained as a result of investigating effects of various elements on an amount of martensite structure, indicating elements being effect for an amount of martensite structure and the degree of the effects. The MI value in excess of 0% may produce a scattered austenite structure in quenched structure, with a Vickers hardness of 500 or less, thus defining the upper limit as less than 0%.

The formula for $W_1$ was obtained as a result of investigating effects of various elements on softening resistance at annealing for the base material, indicating an element being effective for softening resistance at annealing and the degree of the effect. A $W_1$ value in excess of 260% may raise the softening resistance, with a Vickers hardness after annealing of 300 or more, worsening the formability of products, thus defining the upper limit as less than 260%.

The formula for $W_2$ indicates an element being effective for softening resistance at annealing and the degree of the effect. A $W_2$ value in excess of 260% may raise the softening resistance, with a Vickers hardness after annealing of 300 or more, worsening the formability of products, thus defining the upper limit as less than 260%.

The present invention is comprised of the abovementioned constituents and the following structures.

The steel of the present invention consists of a martensite structure or tempered martensite structure. Cr carbides, especially Cr carbides existing along grain boundaries of old austenite, may deteriorate rusting resistance, therefore it is advisable not to allow them to be precipitated in the structure.

Figure 4:
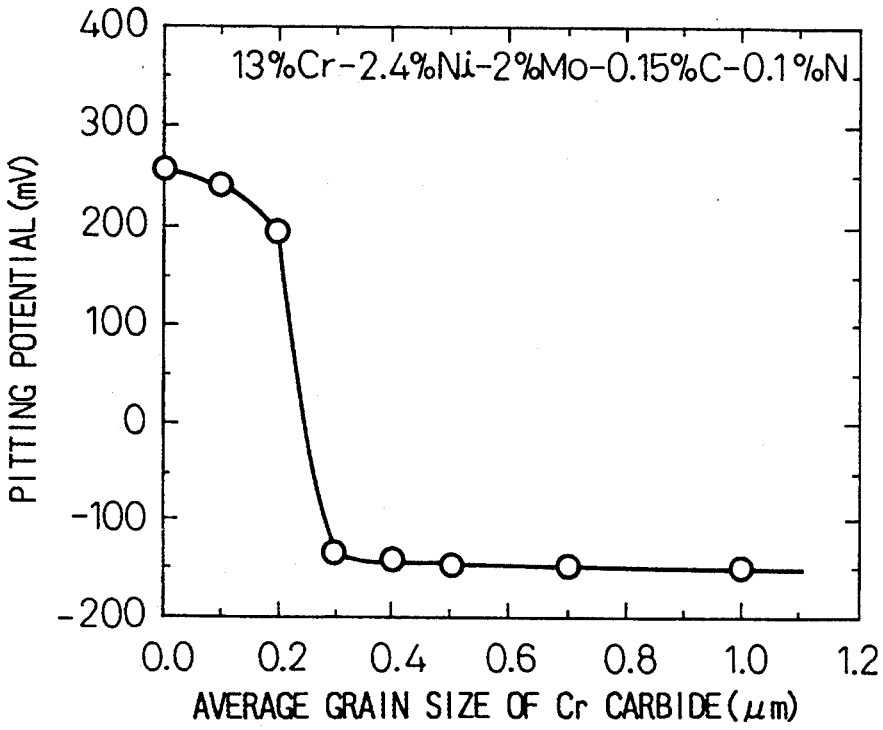
FIG. 4 is a graph showing the relation of pitting corrosion generating potential vs. average grain size of a Cr carbide.

FIG. 4 shows the relation between the average grain size of Cr carbites and pitting potential (which indicates rusting resistance), obtained by varying a cooling rate at quenching, when treating martensitic stainless steel in a process of the present invention, in which said martensitic stainless steel comprises 13.0% of Cr; 2.4% of Ni; 2.0% of Mo; 0.15% of C; 0.1% of N; and the balance being Fe. From FIG. 4, it is seen that rusting resistance is best when Cr carbide is zero (that is, grain size is zero). On the other hand, a grain size of Cr carbide in excess of 0.2 μ rapidly decreases pitting potential to extremely deteriorate rusting resistance. Therefore, in the present invention, the upper limit of average grain size of Cr carbide is defined as 0.2 μm.

Martensitic stainless steel consisting of the abovementioned constituents and structures has rusting resistance equivalent to or better than SUS304 (pitting potential: 200 mV or more) and a high hardness characteristic with a martensite hardness of 500 or more in Hv.

Referring now to the production of the abovementioned steel, the subject process comprises the steps of smelting steel containing the above-mentioned constituents; forming a billet from steel smelted by casting; and treating the billet by hot rolling after heating to produce a hot rolled wire rod.

Because of the high quenchability of the resultant hot rolled wire rod, it is quenched after completion of hot rolling independent of a finish temperature of hot rolling, to achieve a tensile strength of 1500 N/mm$^2$ or higher.

Therefore, the tensile strength of the wire rod is lowered to 950 N/mm$^2$ or lower by annealing in order to subject the rod to high cold working in a post process.

For annealing the above-mentioned wire rod, it takes about 500 to 1000 hours in order to obtain a tensile strength of 950 N/mm$^2$ or less under ordinary annealing (annealing temperature: 600° to 800° C.) because of a low $Ac_1$ temperature of less than 750° C. For this reason, it is desirable to carry out two-stage annealing: a first stage annealing ($Ac_1$ or higher) at 700° to 800° C. for 0.5 to 50 hours; cooling down to 100° C. or lower; then, a second-stage annealing (Ac or lower) at 600° to 750° C. for 0.5 to 50 hours.

After lowering the tensile strength to 950 N/mm$^2$ or less by annealing as described above, the wire rod is subjected to a wire drawing process (draft rate: 1 to 95%), then, according to demand, to ordinary annealing, e.g., at 600° to 800° C. for 1 to 200 mins., and subsequently, to a cold working process, that is, cutting, forging, etc., to obtain a product.

In any case, it is important to lower the tensile strength of the wire rod to 950 N/mm$^2$ or less before cold working.

Products obtained after cold working of the wire rod are heated and kept at 1050 to 1300° C. for 1 to 200 mins. and subsequently quenched, i.e., cooled rapidly into an ambient temperature at cooling rate of 0.5 to 20 °C./sec.

Quenching (especially, controlling of cooling rate) of the steel containing the constituents investigated in the present invention make it possible not only to control the grain size. of Cr carbide to 0.2 μm or less (including zero), but also to obtain a martensite structure.

The steel structure obtained has high rusting resistance corresponding to 200 mV or higher in pitting potential and a high hardness of 500 or more in Hv. These characteristics may be obtained in the same manner even in the case where the tempering process is carried out at 100 to 400° C. for 3 to 200 mins. after quenching in order to add toughness.

As described above, the martensitic stainless steel of this invention is most suited for production of a self-drilling-tapping screw as shown in FIG. 1 because of its high cold workability, high strength and high rusting resistance.

Referring now to the production of this self-drilling-tapping screws, billets made of the steel of the present invention are subjected to hot rolling to obtain a hot rolled wire rod. And then, said hot rolled wire rod is subjected to annealing, for example, two-stage annealing as described previously, subsequently to a wire drawing process to obtain a wire having a desired diameter, and then, subjected to ordinary annealing to form the self-drilling-tapping screw.

The tensile strength of the wire rod has been controlled at 950 N/mm$^2$ or less, facilitating a heading process, etc.

Self-drilling-tapping screws already formed are heated to 1050 to 1300° C., then kept at that temperature for 1 to 200 mins. and subsequently quenched at a cooling rate of 0.5 to 20° C.

If the quenching temperature is lower than 1050° C., Cr carbides may precipitate to deteriorate the rusting resistance and the toughness, besides an amount of solid solution of C may decrease to deteriorate screwing ability because of poor quenched strength. Therefore, the quenching temperature should be set at 1050° C. or higher. However, raising of the temperature in excess of 1300° C. may conversely cause the appearance of retained austenite and δ-ferrite to not only lower the quenched strength and the screwing ability, but also deteriorate the rusting resistance and the toughness, thus setting the upper limit at 1300° C.

And, if the cooling rate at quenching is less than 0.5 °C./s, Cr carbides may precipitate along grain boundaries to deteriorate the rusting resistance. Therefore, the cooling rate should be set at 0.5 °C./s or higher. However, the rate in excess of 20 °C./s causes cracking at quenching process, thus setting the upper limit at 20° C.

These screws processed as described above are subjected to a tempering process at 100 to 400° C. for 3 to 200 mins. to add the toughness. In this process, if the temperature is set lower than 100° C., the toughness cannot be added, and if 400° C. or higher, the screwing ability decrease due to low hardness of less than 500 in Hv.

Thus, the present invention enables to form the self drilling-tapping screw having the desired characteristics as a single body.

Example 1

Table 1 (1) and Table 1 (2) show the constituents contained in the steel No. 1 to No. 24 obtained by the present invention and those contained in referred steel (for purpose of comparison) No. 25 to No. 41, respectively.

The invented steel No. 1 to No. 5 and referred steel No. 25 to No. 27 were obtained by changing Ni contents (wt %) and Mn contents (wt %) which are elements for producing austenite, as the basic constituents being contained 13.0% of Cr - 2.0% of Mo - 0.15% of C - 0.10% of N.

The invented steel No. 6 to No. 10 and referred steel No. 28 to No. 31 were obtained by changing C contents (wt %) and N contents (wt %), as the basic constituents being contained 14.0% of Cr - 2.0% of Ni 2.0% of Mo - 0.5% of Mn.

The invented steel No. 11 to No. 15 and referred steel No. 32 to No. 37 were obtained by changing Cr contents (wt %) and Mo contents (wt %), as the basic constituents being contained 2.0% of Ni - 0.2% of Mn 0.15% of C - 0.10% of N.

The invented steel No. 16 to No. 18 and referred steel No. 38 were obtained by changing B contents (wt %), as the basic constituents being contained 13% of Cr - 2% of Ni - 2% of Mo -0.2% of Mn - 0.15% of C - 0.10% of N.

The invented steel No. 19 to No. 24 and referred steel No. 39 to No. 41 were obtained by changing Ti contents (wt %) and Nb contents (wt %), as the basic constituents being contained 13.5% of Cr - 2.0% of Ni 2.0% of Mo - 1.2% of Mn - 0.15% of C - 0.10% of N.

TABLE 1 (1)

| | No. | Constituent (Weight %) | | | | | | | | | | | |
|---|---|---|---|---|---|---|---|---|---|---|---|---|---|
| | | C | Si | Mn | P | S | Ni | Cr | Mo | N | B | Ti | Nb |
| The present invention steel | 1 | 0.16 | 0.2 | 0.1 | 0.010 | 0.002 | 1.1 | 13.1 | 2.0 | 0.10 | — | — | — |
| | 2 | 0.15 | 0.1 | 0.2 | 0.015 | 0.006 | 2.3 | 13.0 | 1.9 | 0.10 | — | — | — |
| | 3 | 0.15 | 0.2 | 0.5 | 0.021 | 0.004 | 2.0 | 13.2 | 2.0 | 0.10 | — | — | — |
| | 4 | 0.15 | 0.2 | 1.8 | 0.035 | 0.003 | 1.2 | 13.0 | 2.1 | 0.10 | — | — | — |
| | 5 | 0.15 | 0.2 | 1.7 | 0.019 | 0.004 | 2.4 | 13.1 | 2.0 | 0.10 | — | — | — |
| | 6 | 0.13 | 0.3 | 0.5 | 0.025 | 0.007 | 2.0 | 13.9 | 2.0 | 0.07 | — | — | — |
| | 7 | 0.13 | 0.2 | 0.6 | 0.032 | 0.004 | 1.9 | 14.0 | 1.9 | 0.13 | — | — | — |
| | 8 | 0.15 | 0.1 | 0.6 | 0.033 | 0.006 | 2.1 | 14.0 | 2.1 | 0.10 | — | — | — |
| | 9 | 0.19 | 0.2 | 0.6 | 0.028 | 0.007 | 2.0 | 14.0 | 2.0 | 0.07 | — | — | — |
| | 10 | 0.18 | 0.2 | 0.6 | 0.032 | 0.010 | 2.1 | 14.0 | 2.1 | 0.12 | — | — | — |
| | 11 | 0.16 | 0.2 | 0.3 | 0.047 | 0.003 | 2.1 | 12.6 | 1.5 | 0.09 | — | — | — |
| | 12 | 0.15 | 0.2 | 0.2 | 0.035 | 0.005 | 2.1 | 15.4 | 1.5 | 0.10 | — | — | — |
| | 13 | 0.15 | 0.2 | 0.2 | 0.019 | 0.004 | 1.9 | 13.1 | 2.0 | 0.09 | — | — | — |
| | 14 | 0.16 | 0.2 | 0.2 | 0.025 | 0.008 | 2.0 | 14.0 | 2.8 | 0.10 | — | — | — |
| | 15 | 0.15 | 0.3 | 0.2 | 0.015 | 0.006 | 1.9 | 13.0 | 3.3 | 0.09 | — | — | — |
| | 16 | 0.15 | 0.2 | 0.2 | 0.033 | 0.006 | 2.1 | 13.1 | 2.0 | 0.10 | 0.002 | — | — |
| | 17 | 0.15 | 0.2 | 0.2 | 0.033 | 0.006 | 2.1 | 13.1 | 2.0 | 0.10 | 0.004 | — | — |
| | 18 | 0.16 | 0.2 | 0.2 | 0.011 | 0.009 | 2.0 | 13.1 | 2.0 | 0.10 | 0.008 | — | — |
| | 19 | 0.16 | 0.1 | 1.1 | 0.032 | 0.010 | 2.0 | 13.5 | 2.2 | 0.10 | — | — | — |
| | 20 | 0.15 | 0.1 | 1.1 | 0.025 | 0.004 | 2.0 | 13.5 | 2.2 | 0.10 | — | 0.40 | — |
| | 21 | 0.15 | 0.1 | 1.2 | 0.035 | 0.005 | 2.1 | 13.5 | 2.0 | 0.10 | — | 0.85 | — |
| | 22 | 0.15 | 0.1 | 1.1 | 0.032 | 0.010 | 1.9 | 13.4 | 2.0 | 0.10 | — | 0.50 | 0.40 |
| | 23 | 0.15 | 0.1 | 1.1 | 0.047 | 0.004 | 1.9 | 13.6 | 2.0 | 0.11 | — | — | 0.46 |
| | 24 | 0.15 | 0.1 | 1.2 | 0.035 | 0.005 | 2.1 | 13.6 | 2.1 | 0.10 | — | — | 0.75 |

TABLE 1 (2)

| | No. | Constituent (Weight %) | | | | | | | | | | | |
|---|---|---|---|---|---|---|---|---|---|---|---|---|---|
| | | C | Si | Mn | P | S | Ni | Cr | Mo | N | B | Ti | Nb |
| The comparison steel | 25 | 0.14 | 0.2 | 0.2 | 0.022 | 0.007 | 0.2* | 13.1 | 2.1 | 0.09 | — | — | — |
| | 26 | 0.16 | 0.2 | 0.2 | 0.014 | 0.003 | 5.8* | 13.1 | 2.0 | 0.10 | — | — | — |
| | 27 | 0.15 | 0.2 | 3.1* | 0.036 | 0.004 | 2.4 | 13.1 | 2.0 | 0.10 | — | — | — |
| | 28 | 0.10* | 0.2 | 0.4 | 0.022 | 0.005 | 2.2 | 13.9 | 1.9 | 0.10 | — | — | — |
| | 29 | 0.25* | 0.1 | 0.4 | 0.035 | 0.009 | 1.9 | 13.9 | 1.9 | 0.09 | — | — | — |
| | 30 | 0.18 | 0.3 | 0.6 | 0.038 | 0.003 | 2.1 | 14.2 | 2.2 | 0.16* | — | — | — |
| | 31 | 0.15 | 0.3 | 0.6 | 0.043 | 0.004 | 2.1 | 13.9 | 1.9 | 0.03* | — | — | — |
| | 32 | 0.16 | 0.2 | 0.2 | 0.034 | 0.008 | 2.0 | 10.9* | 1.1* | 0.09 | — | — | — |
| | 33 | 0.15 | 0.2 | 0.3 | 0.034 | 0.009 | 2.0 | 13.5 | 0.6* | 0.09 | — | — | — |
| | 34 | 0.16 | 0.2 | 0.2 | 0.029 | 0.010 | 2.0 | 12.0 | 1.3 | 0.09 | — | — | — |
| | 35 | 0.14 | 0.2 | 0.2 | 0.030 | 0.008 | 2.1 | 16.5* | 2.0 | 0.10 | — | — | — |
| | 36 | 0.14 | 0.2 | 0.2 | 0.042 | 0.008 | 2.1 | 13.0 | 4.0* | 0.08 | — | — | — |
| | 37 | 0.15 | 0.2 | 0.2 | 0.044 | 0.004 | 2.0 | 15.0 | 3.2 | 0.09 | — | — | — |
| | 38 | 0.16 | 0.2 | 0.2 | 0.045 | 0.009 | 1.9 | 13.1 | 2.0 | 0.10 | 0.012* | — | — |
| | 39 | 0.15 | 0.2 | 1.3 | 0.037 | 0.007 | 2.0 | 13.6 | 2.2 | 0.10 | — | 1.60* | — |
| | 40 | 0.15 | 0.2 | 1.4 | 0.023 | 0.006 | 2.1 | 13.5 | 2.1 | 0.10 | — | — | 1.60* |
| | 41 | 0.15 | 0.2 | 1.2 | 0.022 | 0.005 | 2.1 | 13.6 | 2.2 | 0.10 | — | 0.80 | 0.80 |

Note:
Mark * shows a constituent being out of a range of the present invention.

The invented steel and referred steel mentioned above were processed through steps: smelting; hot rolling of wire rod; and annealing at 1000° C., in an ordinary process line for stainless steel wire.

As a first-stage annealing, hot rolled wire rod obtained through steps mentioned above was heated to 40° C.; then kept at this temperature for 4 hours; and subsequently cooled down to 50° C.; again heated, as a second-stage, to 650° C. and kept at this temperature for hours; then, cooled down to an ambient temperature. The tensile strength of wire rod obtained through this annealing process was shown in the region of 800 to 200 N/film$^2$.

Above-mentioned wire rod was then subjected to the steps: applying wire drawing about 25%; then, annealing at 700° C. for 10 mins; applying heading process by forging for a hexagonal head; and subsequently heating this processed material to 1100° C. and keeping it for 10 mins.; then, quenching from said temperature at a cooling rate of 5 °C./s; again, heating to 200° C. and keeping for 30 mins. for tempering. As a result, steel of tempered martensite structure with finely precipitated Cr carbides was obtained.

Then, a series of tests were carried out for evaluating the hardness of said heat-treated process material, the rusting resistance and the toughness. According to JISZ2244 was measured the hardness of the central portion across the lengthwise section of wire rod. A hardness rank in these examples was selected 500 or higher in the Vickers hardness.

In the rusting resistance evaluating test, a sample plate of 100×50×1 mm was evaluated after 500-hour testing according to JISZ2371, in which the sample plate was obtained by steps of forming rolled wire rod to a flat plate through hot rolling then, applying cold rolling and subsequently polishing processes. A rusting resistance rank in these examples was selected 9.5 or more in the JIS evaluation point.

The toughness test was performed according to JISZ2202 at an ambient temperature by using U-notch sized 7.5 mm dia.×55 mm and 1 mm in depth, and the toughness was evaluated with Charpy value obtained in this test. A toughness rank in these examples was selected 6.0/cm$^2$ or more.

The cold workability was judged by occurrence of cracking at heading process of a collar hexagonal head using a cold doubleheader. That is, the cold workability was evaluated to be good when processed without any cracking, and faulty when cracked.

Results obtained under testings mentioned above are shown in Table 2 (1) (invention examples) and Table 2 (2)(comparison examples).

Evidently from each Table, all the invention examples satisfied the characteristic ranks mentioned above, however in the comparison example No. 25, the DI value became high because of low Ni contents (%), indicating the quenched hardness, the rusting resistance and the toughness being inferior. The comparison example No. 26 indicated worse cold workability because of high Ni contents (%) and worse quenched hardness because that the MI value became more than 0%. The comparison example No. 15 indicated worse rusting resistance because of high Mn contents (%).

The comparison example No. 28 indicated inferior hardness because of low C contents (%). The comparison example No. 29 indicated worse rusting resistance and toughness as well as worse cold workability because of high C contents (%) and precipitation of coarse carbides. The comparison example No. 30 indicated not only worse hardness and rusting resistance because that austenite was appeared, high MI value of more than 0% was retained and Cr-carbide and nitride was formed due to high N contents (%), but also inferior producibility because of appearance of blowholes. Reference No. 31 indicated worse hardness because of low N contents (%).

The comparison example No. 32 indicated worse rusting resistance because of low Cr contents (%) and low Mo contents (%) causing low ARI value. The comparison example No. 33 indicated worse rusting resistance because of low ARI value caused by low Mo contents (%). The comparison example No. 34 indicated not only worse rusting resistance because of appearance of δ-ferrite caused by high ARI value of more than 0% due to low Cr contents (%), but also worse cold workability because of high $W_1$ value and high material hardness. The comparison example No. 35 indicated not only worse rusting resistance because of appearance of δ-ferrite caused by high DI value of more than 0% due to high Cr contents (%), but also worse cold workability because of high $W_1$ value and high material hardness. The comparison example No. 36 indicated not only worse rusting resistance because of appearance of δ-ferrite caused by high DI value of more than 0% due to high Mo contents (%), but also worse cold workability because of high $W_1$ value and high material hardness. The comparison example No. 37 indicated not only worse rusting resistance because of appearance of δ-ferrite caused by high DI value of more than 0%, but also worse cold workability because of high $W_1$ value and high material hardness.

The invention examples No. 16 to 18 were superior in hardness and toughness to the invention example No. 13 because of the addition of B contents (%) to the formers. The comparison example No. 38 indicated worse rusting resistance and toughness because of high B contents (%).

The invention examples No. 20 and 21 were superior in rusting resistance to the invention example No. 19 because of the addition of Ti to the formers. The invention example No. 22 was superior in rusting resistance to the invention example No. 19 because of the addition of both Ti and Nb to the former. The invention examples No. 23 and 24 were superior in rusting resistance to the invention example No. 19 because of the addition of Nb to the formers. However, the comparison examples No. 39 to 41 indicated worse cold workability because of high $W_2$ value due to too high Ti and Nb contents (%).

TABLE 2 (1)

| | No. | Steel No. | ARI (%) | DI (%) | MI (%) | $W_1$ (%) | $W_2$ (%) | Hardness (Hv) | Rusting resistance (evaluated by salt spray testing) | Toughness (Charpy value) $\mu E_{RT}$-J/cm$^2$ | Workability |
|---|---|---|---|---|---|---|---|---|---|---|---|
| The present invention example | 1 | 1 | 17.9 | −1.3 | −3.8 | 225.1 | — | 558 | 9.8-3 | 65 | o |
| | 2 | 2 | 17.6 | −2.5 | −3.3 | 222.6 | — | 546 | 9.8-4 | 80 | o |
| | 3 | 3 | 18.0 | −1.9 | −3.1 | 229.8 | — | 548 | 9.8-3 | 73 | o |
| | 4 | 4 | 18.0 | −1.3 | −3.8 | 236.5 | — | 551 | 9.8-6 | 68 | o |
| | 5 | 5 | 17.9 | −2.5 | −2.7 | 236.0 | — | 540 | 9.8-6 | 76 | o |
| | 6 | 6 | 18.7 | −0.1 | −3.5 | 239.7 | — | 511 | 9.8-2 | 83 | o |
| | 7 | 7 | 18.6 | −1.1 | −2.7 | 238.5 | — | 545 | 9.8-3 | 70 | o |
| | 8 | 8 | 19.0 | −1.1 | −2.3 | 242.9 | — | 551 | 9.8-2 | 74 | o |
| | 9 | 9 | 18.8 | −1.5 | −1.8 | 241.0 | — | 570 | 9.8-4 | 65 | o |
| | 10 | 10 | 19.0 | −2.1 | −1.0 | 243.5 | — | 574 | 9.8-3 | 61 | o |
| | 11 | 11 | 16.2 | −3.2 | −4.0 | 208.7 | — | 555 | 9.8-6 | 86 | o |
| | 12 | 12 | 19.0 | −0.3 | −1.8 | 245.3 | — | 535 | 9.8-2 | 80 | o |
| | 13 | 13 | 17.9 | −1.6 | −3.5 | 226.5 | — | 540 | 9.8-3 | 83 | o |
| | 14 | 14 | 20.7 | −0.3 | −1.3 | 257.8 | — | 511 | 9.8-1 | 79 | o |
| | 15 | 15 | 20.9 | −0.1 | −2.0 | 257.0 | — | 534 | 9.8-1 | 85 | o |
| | 16 | 16 | 17.9 | −2.3 | −2.8 | 226.7 | — | 553 | 9.8-3 | 95 | o |
| | 17 | 17 | 17.9 | −2.3 | −2.8 | 226.7 | — | 561 | 9.8-3 | 105 | o |
| | 18 | 18 | 17.9 | −2.2 | −2.9 | 226.6 | — | 572 | 9.8-3 | 112 | o |
| | 19 | 19 | 18.8 | −1.4 | −2.7 | — | 241.6 | 534 | 9.8-5 | 80 | o |
| | 20 | 20 | 18.8 | −1.4 | −2.7 | — | 245.6 | 534 | 9.8-3 | 80 | o |
| | 21 | 21 | 18.3 | −1.8 | −2.8 | — | 246.0 | 541 | 9.8-1 | 76 | o |
| | 22 | 22 | 18.2 | −1.7 | −3.1 | — | 246.3 | 542 | 9.8-1 | 75 | o |
| | 23 | 23 | 18.4 | −1.7 | −2.8 | — | 244.9 | 550 | 9.8-3 | 80 | o |
| | 24 | 24 | 18.6 | −1.6 | −2.6 | — | 252.4 | 541 | 9.8-1 | 76 | o |

o: Good.
x: No-good

TABLE 2 (2)

| | No. | Steel No. | ARI (%) | DI (%) | MI (%) | $W_1$ (%) | $W_2$ (%) | Hardness (Hv) | Rusting resistance (evaluated by salt spray testing) | Toughness (Charpy value) $\mu E_{RT}$J/cm$^2$ | Workability |
|---|---|---|---|---|---|---|---|---|---|---|---|
| The comparison example | 25 | 25 | 18.1 | 0.4* | −5.4 | 227.1 | — | 490* | x 9-2 | x 48 | o |
| | 26 | 26 | 17.9 | −6.0 | 0.9 | 230.4 | — | 356* | o 9.8-3 | o 251 | o |
| | 27 | 27 | 17.9 | −2.6 | −2.5 | 244.4 | — | 541 | x 9.3-5 | o 78 | o |
| | 28 | 28 | 18.5 | −0.2 | −4.0 | 236.3 | — | 441* | o 9.8-2 | o 120 | o |
| | 29 | 29 | 18.5 | −3.5 | −0.1 | 235.4 | — | 502 | x 8-5 | x 21 | x |
| | 30 | 30 | 19.5 | −2.5 | 0.2 | 249.2 | — | 321* | x 9-5 | o 180 | o |
| | 31 | 31 | 18.5 | −0.1 | −3.7 | 238.0 | — | 467* | o 9.8-3 | o 92 | o |
| | 32 | 32 | 13.5* | −5.3 | −6.0 | 175.8 | — | 543 | x 9-5 | o 82 | o |
| | 33 | 33 | 14.9* | −3.0 | −4.7 | 199.0 | — | 548 | x 9.3-6 | o 78 | o |
| | 34 | 34 | 15.1* | −3.9 | −4.8 | 195.2 | — | 553 | x 9.3-3 | o 80 | o |
| | 35 | 35 | 21.3 | 1.6* | −0.6 | 272.0* | — | 506 | x 8-2 | o 74 | x |
| | 36 | 36 | 22.6 | 0.9* | −1.5 | 273.4* | — | 511 | x 8-3 | o 72 | x |
| | 37 | 37 | 22.7 | 1.6* | −0.4 | 280.7* | — | 501 | x 8-4 | o 80 | x |
| | 38 | 38 | 17.9 | −2.1 | −3.0 | 226.5 | — | 568 | x 9-6 | x 41 | o |
| | 39 | 39 | 18.9 | −1.3 | −2.5 | — | 260.7* | 5 34 | o 9.8-1 | o 80 | x |
| | 40 | 40 | 18.5 | −1.6 | −2.5 | — | 265.7* | 541 | o 9.8-1 | o 76 | x |
| | 41 | 41 | 18.9 | −1.4 | −2.4 | — | 264.2* | 546 | o 9.8-1 | o 77 | x |

Note:
(1) Mark * shows a case being out of a range of the present invention.
(2) o: Good, x: No-good From these examples the steel obtained by the present invention clearly shows the predominace.

Example 2

Table 2 shows a comparison of cold workability between the invented steel and referred one. These examples were prepared by using steel containing constituents of the invented steel No. 3 described in Table 1. The hot rod rolled materials obtained from said steel were divided into 3 groups: for 2-stage annealing (No. 43); for 1-stage annealing (No. 42); without annealing (No. 44), wherein 2-stage annealing was carried out under the condition: first 750° C. for 1 hour 1 hour; second 650° C. for 1hour; 1-stage annealing under 700° C. for 1000 hours. After these process, each material was subjected to wire drawing; ordinary annealing; then, heading process by cold forging.

These examples were evaluated with the strength of material before heading process and the cold workability at heading.

The strength of material was measured by a tensile tester according to JISZ2201.

The invention examples No. 42 and No. 43 showed the tensile strength of 930 N/mm$^2$ and 910 N/mm$^2$, respectively, indicating to be good in cold workability. On the other hand, the comparison example No. 44 showed the tensile strength of 1600 N/mm$^2$, therefore said wire drawing could not be done, indicating poor cold workability.

TABLE 3

| | No. | Steel No | Production line | Rod intensity (N/mm$^2$) | Cold workability |
|---|---|---|---|---|---|
| The present invention example | 42 | No. 3 | Wire rod rolling → 700° C. annealing → Wire drawing → Annealing → Heading process | 930 | o |
| The present invention example | 43 | No. 3 | Wire rod rolling → 2-stage annealing → Wire drawing → Annealing → Heading process | 910 | o |
| The comparison example | 44 | No. 3 | Wire rod rolling → Wire drawing impossible | 1600 | x |

Note:
o: Good,
x: No-good

From these examples the steel obtained by the present invention clearly shows the predominace.

Example 3

Table 4 (1) and Table 4 (2) show the comparison between the invention example and comparison example in the production of self drilling-tapping screws.

The invention example No. 45 was prepared by smelting and hot rolling to obtain a wire rod the steel No. 3 indicated in Table 1 (1) in an ordinary process line. Then, said hot rolled wire rod being subjected to 2-stage annealing (1-stage: 760° C. for 1hour; 2-stage: 70° C. for 1hour); wire drawing of 25% in draft; annealing of 700° C. for 10 mins., to obtain crude wire before forming self drilling-tapping screws. Then, the crude wire was subjected to forming process for self drilling-tapping screws through cold forging, pressing and forming by rolling; subsequently, quenching at cooling rate of 5°C./s after being maintained at a temperature of 1150° C. for 10 mins.; then, tempering at a temperature of 200° C. for 30 mins.

The comparison examples No. 46 to 51 show the cases in ordinary self drilling-tapping screws. Forming process for screws in these comparison examples was performed in the process line for ordinary stainless drilling-tapping screws. After forming of said screws, the comparison example No. 46 (SUS410 type) was subjected to nitriding and quenching/tempering; then, Ni-Cr plating on the surface layer of the screws. The comparison example No. 47 (SUS304 type) was subjected to nitriding for hardening the surface of the screws, and the comparison example No. 48 was subjected to further dachro treatment on said nitrided surface for adding the rusting resistance. The comparison example No. 49 (SUS305 type) was subjected to nitriding for hardening the surface of the screws, subsequently removing nitrided layer on the only head part of screws by shot treating and pickling for adding the rusting resistance. The comparison example No. 50 which was formed by a high strength Mn austenitic stainless steel was aged. The comparison example No. 51 which was formed by a (high strength austenitic stainless steel) was aged, then subjected to Zn plating for adding lubrication property at screwing.

TABLE 4 (1)

| | No. | Constituent (weight %) C | Si | Mn | P | S | Ni | Cr | Mo | N | Process after formation | JIS |
|---|---|---|---|---|---|---|---|---|---|---|---|---|
| The present invention example | 45 | 0.15 | 0.20 | 0.50 | 0.02 | 0.0042 | 2.0 | 13.2 | 2.0 | 0.10 | 1150° C. quenching, 200° C. tempering | — |
| The comparison example | 46 | 0.10 | 0.39 | 0.93 | 0.03 | 0.0035 | 0.1 | 11.6 | 0.0 | 0.01 | Nitrided quenching, Tempering and Ni—Cr plating | SUS410 |
| | 47 | 0.03 | 0.45 | 1.10 | 0.02 | 0.0023 | 8.3 | 18.4 | 0.0 | 0.01 | Nitriding treatment | SUS304 |
| | 48 | 0.03 | 0.45 | 1.10 | 0.02 | 0.0023 | 8.3 | 18.4 | 0.0 | 0.01 | Nitriding treatment and dachro process | SUS304 |
| | 49 | 0.03 | 0.45 | 1.10 | 0.02 | 0.0025 | 10.3 | 18.3 | 0.0 | 0.01 | Nitriding treatment, screw head shot and pickling | SUS305 |
| | 50 | 0.08 | 0.43 | 9.50 | 0.03 | 0.0030 | 5.5 | 18.0 | 0.0 | 0.30 | Aging treatment | — |
| | 51 | 0.10 | 0.30 | 1.72 | 0.02 | 0.0020 | 11.6 | 18.3 | 0.0 | 0.23 | Aging treatment and Zn plating | — |

Producibility in these examples was evaluated due to the cold workability at forming of the screws and a tool lifetime. The product characteristics was evaluated with the hardness of a cutting edge, screwing ability and rusting resistance. Table 4 (2) shows these values.

A tool lifetime was evaluated by the numbers of headings without damage of a punch: that is, good at 10000 or more, not good at less than 10000.

And, hardness was evaluated by measuring a position at 0.1 mm under from the cutting edge surface according to JISZ2244.

Screwing ability was evaluated by screwing into SS400 steel plate having a thickness of 5.5 mm according to JISB1125. Namely, when screwing was carried out without damage, screwing ability was good, but when screwing could not be carried out without damage, screwing ability was not good.

Rusting resistance was evaluated by inserting a self drilling-tapping screw in styrol foam at the angle of 20° and leaving it for 500 hours according to JISZ2371. When the surface of a screw head rusted, rusting resistance was good, but when a dotted and overall rust were recognized, this was not good.

Evidently from Table 4 (2), the invention examples were good in producibility and the product characteristics. On the other hand, the comparison example No. 46 (nitrided and quenched sample of SUS410) showed worse rusting resistance. The comparison example No. 47 (surface nitrided sample of SUS304) showed worse rusting resistance. The comparison example No. 48 (surface nitrided and dachro treated sample of SUS304) was inferior in rusting resistance, besides being expensive. The comparison example No. 49 (sample of SUS305 having surface nitrided and head part shot/-pickled) was inferior in rusting resistance because that surface nitriding layer could not thoroughly be removed, besides being expensive. The comparison example No. 50 (aged sample of high Mn-high strength austenitic stainless steel) was inferior in cold workability and tool lifetime because of high work hardening/high strength, besides being inferior in rusting resistance because of rust which was generated from working a cracked portion. The comparison example No. 51 (aged and Zn plated sample of high strength austenitic stainless steel) was inferior in cold workability and tool lifetime because of high work hardening/high strength, besides being inferior in rusting resistance because of overall rust which was generated on the surface of the plating material.

TABLE 4 (2)

| | No. | Producibility: Cold workability | Producibility: Tool lifetime | Product characteristic: Cutting edge hardness (Hv) | Product characteristic: Screwing ability | Product characteristic: Rusting resistance |
|---|---|---|---|---|---|---|
| The present invention example | 45 | o | o | 524 | o | o |
| The comparison example | 46 | o | o | 604 | o | x |
| | 47 | o | o | 802 | o | x |
| | 48 | o | o | 853 | o | x |
| | 49 | o | o | 824 | o | x |
| | 50 | x | x | 463 | x | x |
| | 51 | x | x | 472 | x | x |

Note:
o: Good,
x: No-good

From these examples the self drilling-tapping screw by the present invention clearly shows the predominace.

As is evident from each example mentioned above, the present invention enables to provide at a low price a screw which is superior in screwing ability and rusting resistance; a nail which is superior in driving ability and rusting resistance; a cutter having excellent rusting resistance; and a high strength spring having excellent rusting resistance, to bring about a profitable effect to industry.

We claim:

1. High strength martensitic stainless steel having high rusting resistance which consists essentially of, by weight, 0.13 to 0.20% of C, 0.1 to 0.5% of Si, 0.1 to 2.0% of Mn, 1.0 to 2.5% of Ni, 12.0 to 16.0% of Cr, 1.3 to 3.5% of Mo, 0.06 to 0.13% of N, which satisfies 16 to 21% of ARI value expressed by Formula (1), less than 0% of DI value expressed by Formula (2), less than 0% of MI value expressed by Formula (3), less than 260% of $W_1$ value expressed Formula (4), with the balance comprising substantially Fe and inevitable impurities, wherein said steel has a martensite structure or a tempered martensite structure is formed, in which a Cr carbide of 0.2 μm or less (including zero) in grain size is precipitated $$ARI = Cr + 2.4Mo \qquad \text{Formula (1)}$$

$$DI = Cr + 1.21Mo + 0.48Si + 2.48Al (24.5C + 18.4N + Ni + 0.11Mn) - 10.0 \qquad \text{Formula (2)}$$

$$MI=Ni+30C+0.12Mn+18N+0.83(Cr+1.5Si+1.4Mo)-25.0 \quad \text{Formula (3)}$$

$$W_1=24Mo+13.3Cr+6Mn+6Si+Ni \quad \text{Formula (4)}$$

2. High strength martensitic stainless steel according to claim 1, wherein said stainless steel further comprises 0.001 to 0.010% by weight of B.

3. High strength martensitic stainless steel according to claim 1, wherein further comprises, by weight, 0.05 to 1.0% of Ti and 0.05 to 1.0% of Nb, and less than 260% of $W_2$ value expressed by Formula (5), with the balance comprising substantially Fe and inevitable impurities $$W_2=24Mo+13.3Cr+6Mn+6Si+Ni \quad \text{Formula (5)}$$

+10Ti +10Nb Formula ... (5)

4. A process for manufacturing a martensitic stainless steel wire rod having the wire rod tensile strength of 950 N/mm$^2$ or less, which comprises hot-rolling a billet consisting essentially of, by weight, 0.13 to 0.20% of C, 0.1 to 0.5% of Si, 0.1 to 2.0% of Mn, 1.0 to 2.5% of Ni, 12.0 to 16.0% of Cr, 1.3 to 3.5% of Mo, 0.06 to 0.13% of N, which satisfies 16 to 21% of ARI value expressed by Formula (1), less than 0% of DI value expressed by Formula (2), less than 0% of MI value expressed by Formula (3), less than 260% of $W_1$ value expressed Formula (4), with the balance comprising substantially Fe and inevitable impurities, and annealing a wire rod obtained by hot-rolling $$ARI=Cr+2.4Mo \quad \text{Formula (1)}$$

$$DI=Cr+1.21Mo+0.48Si+2.48Al(24.5C+18.4N+Ni+0.11Mn)-10.0 \quad \text{Formula (2)}$$

$$MI=Ni+30C+0.12Mn+18N+0.83(Cr+1.5Si+1.4Mo)-25.0 \quad \text{Formula (3)}$$

$$W_1=24Mo+13.3Cr+6Mn+6Si+Ni \quad \text{Formula (4)}$$

5. A process for manufacturing a martensitic stainless steel wire rod according to claim 4, wherein said stainless steel further comprises 0.001 to 0.010% by weight of B.

6. A process for manufacturing a martensitic stainless steel wire rod according to claim 4, wherein said stainless steel further comprises, by weight, 0.05 to 1.0% of Ti and 0.05 to 1.0% of Nb, and less than 260% of $W_2$ value expressed by Formula (5), with the balance comprising substantially Fe and inevitable impurities $$W_2=24Mo+13.3Cr+6Mn+6Si+Ni \quad \text{Formula (5)}$$

+10Ti +10Nb Formula ... (5)

7. A process for manufacturing a martensitic stainless steel wire rod according to claim 4, wherein a wire rod obtained by hot-rolling, is annealed at a temperature of 700° to 800° C. for 5 to 50 hours, as a 1st annealing, then, an annealed wire rod is cooled to 100° C. or lower, subsequently, a cooled wire rod is annealed at 600° to 750° C. for 0.5 to 50 hours, as a 2nd annealing.

8. A self drilling-tapping screw having high rusting resistance and hardness of the point of a sword of 500 or more in Hv, which consists essentially of, by weight, 0.13 to 0.20% of C, 0.1 to 0.5% of Si, 0.1 to 2.0% of Mn, 1.0 to 2.5% of Ni, 12.0 to 16.0% of Cr, 1.3 to 3.5% of Mo, 0.06 to 0.13% of N, which satisfies 16 to 21% of ARI value expressed by Formula (1), less than 0% of DI value expressed by Formula (2), less than 0% of MI value expressed by Formula (3), less than 260% of $W_1$ value expressed Formula (4), with the balance comprising substantially Fe and inevitable impurities $$ARI=Cr+2.4Mo \quad \text{Formula (1)}$$

$$DI=Cr+1.21Mo+0.48Si+2.48Al(24.5C+18.4N+Ni+0.11Mn)-10.0 \quad \text{Formula (2)}$$

$$MI=Ni+30C+0.12Mn+18N+0.83(Cr+1.5Si+1.4Mo)-25.0 \quad \text{Formula (3)}$$

$$W_1=24Mo+13.3Cr+6Mn+6Si+Ni \quad \text{Formula (4)}$$

9. A process for manufacturing a self drilling-tapping screw having high rusting resistance and hardness of the point of a sword of 500 or more in Hv, which comprises hot-rolling a billet consisting essentially of, by weight, 0.13 to 0.20% of C, of 0.5 or less of Si, 2.0 or less of Mn, 1.0 to 2.5% of Ni, 12.0 to 16.0% of Cr, 1.3 to 3.5% of Mo, 0.06 to 0.13% of N, which satisfies 16 to 21% of ARI value expressed by Formula (1), less than 0% of DI value expressed by Formula (2), less than 0% of MI value expressed by Formula (3), less than 260% of $W_1$ value expressed Formula (4), with the balance comprising substantially Fe and inevitable impurities, annealing a wire rod obtained by hot-rolling, wire drawing, further annealing, then, cold working and forming a self drilling-tapping screw, subsequently, heating the formed screw to 1050° to 1300° C., then, quenching at cooling rate of 0.5 to 20 °C./sec., and heating again to 100 to 400° C. for tempering $$ARI=Cr+2.4Mo \quad \text{Formula (1)}$$

$$DI=Cr+1.21Mo+0.48Si+2.48Al(24.5C+18.4N+Ni+0.11Mn)-10.0 \quad \text{Formula (2)}$$

$$MI=Ni+30C+0.12Mn+18N+0.83(Cr+1.5Si+1.4Mo)-25.0 \quad \text{Formula (3)}$$

$$W_1=24Mo+13.3Cr+6Mn+6Si+Ni \quad \text{Formula (4)}$$

10. A self drilling-tapping screw having high rusting resistance according to claim 8, wherein said screw further comprises 0.001 to 0.010% by weight of B.

11. A self drilling-tapping screw having high rusting resistance according to claim 8, wherein said screw further comprises, by weight, 0.05 to 1.0% of Ti and 0.05 to 1.0% of Nb, and less than 260% of $W_2$ value expressed by Formula (5), with the balance comprising substantially Fe and inevitable impurities $$W_2=24Mo+13.3Cr+6Mn+6Si+Ni \quad \text{Formula (5)}$$

+10Ti +10Nb Formula ... (5)

* * * * *